US005139090A

United States Patent [19]

Land

[11] Patent Number: 5,139,090

[45] Date of Patent: Aug. 18, 1992

[54] TUBING ROTATOR WITH DOWNHOLE TUBING SWIVEL

[76] Inventor: John L. Land, Box 1997, Hobbs, N. Mex. 88240

[21] Appl. No.: 682,499

[22] Filed: Apr. 8, 1991

[51] Int. Cl.[5] ..... E21B 17/046; E21B 17/05; E21B 43/00

[52] U.S. Cl. ..... 166/369; 166/68; 166/73; 166/78; 166/117.7; 166/216; 166/240; 166/242; 166/382

[58] Field of Search ..... 166/68, 68.5, 69, 73, 166/78, 117.7, 210, 240, 242, 369, 378, 380, 382, 381, 216, 379

[56] References Cited

U.S. PATENT DOCUMENTS

| | | | |
|---|---|---|---|
| 1,560,984 | 11/1925 | Gorbutt . | |
| 1,650,102 | 11/1927 | Tschappat . | |
| 1,965,907 | 7/1934 | Pierce | 166/14 |
| 2,178,700 | 11/1939 | Penick et al. | 166/14 |
| 2,294,061 | 8/1942 | Williamson | 166/78 |
| 2,471,198 | 5/1949 | Cormany | 166/78 |
| 2,595,434 | 5/1952 | Williams | 166/78 |
| 2,630,181 | 3/1953 | Solum | 166/14 |
| 2,693,238 | 11/1954 | Baker | 166/78 |
| 2,788,074 | 4/1957 | Brown | 166/78 |
| 3,075,584 | 1/1963 | Brown | 166/210 X |
| 3,100,538 | 8/1963 | Sanders | 166/117.7 |
| 3,643,737 | 2/1972 | Current et al. | 166/139 X |
| 4,278,278 | 7/1981 | Chambless et al. | 166/240 X |
| 4,601,343 | 7/1986 | Lindsey, Jr. et al. | 166/242 X |

*Primary Examiner*—Hoang C. Dang
*Attorney, Agent, or Firm*—Marcus L. Bates

[57] ABSTRACT

A cased wellbore extends downhole to a pay zone which is produced by a rod actuated downhole pump that lifts fluid from the bottom of the wellbore up through a tubing string to a wellhead. The pump is seated in a pump cavity. The tubing string is tensioned and is rotated. The upper end of the tubing string is attached to a fluid conveying swivel means and a tubing rotator. A combination tubing anchor and fluid conveying swivel is attached adjacent the lower end of the tubing string by which the lower end of the tubing string is rotatably and releasably affixed to the casing in proximity to the lower end of the wellbore. The lower swivel is located adjacent the anchor and enables the tubing string to rotate respective to the anchor while conveying fluid through the rotating tensioned production tubing string.

15 Claims, 2 Drawing Sheets

TUBING ROTATOR WITH DOWNHOLE TUBING SWIVEL

BACKGROUND OF THE INVENTION

In many geographical locations of the world there are more pumpjack units than there are people. These pumpjack units produce crude oil from a production formation located thousands of feet below the ground. Usually the pumpjack unit is supported on the ground adjacent the wellhead and actuates a sucker rod string that extends into the wellbore and downhole to a downhole production pump of the reciprocatory type.

Some of these wells are very old, and for one reason or another, are crooked and therefore the production tubing is curved into a sinusoidal wave pattern at several locations along its length. This meandering of the wellbore forces the sucker rod into engagement with the inner wall surface of the production tubing string, causing it to scrape or rub against the tubing string at a number of elevations as the rod is reciprocated by the horse-head of a pumpjack rocking beam. This scraping accelerates the wear between the outer surface of the sucker rod and the inner surface of the tubing string so that eventually either the rod will part or the tubing string will commence leaking production fluid into the wellbore annulus, and, for many different reasons, either of these conditions is considered highly undesirable and costly.

In the past, tubing rotators have been employed at the surface of the earth to rotate the tubing string respective to the rod and casing strings to thereby distribute the wear between the outer surface of the rod string and the inner surface of the tubing string as opposed to the wear being concentrated at one side of the rod and tubing string. This provides improved wear characteristics of the rod string and tubing string but it also requires that the lower end of the tubing string be left free to rotate and this brings about accelerated failure of several components of the production equipment for reasons other than the rubbing together of the sucker rod and tubing string. This accelerated failure of the production equipment components is a result of the pump plunger cyclically lifting the entire column of fluid up the tubing string several strokes each minute, which cyclically induces an upward force into the production tubing and thereby works or fatigues the multitude of connections located in the tubing. Consequently early failure of these and other production equipment components often results from this arrangement.

It is not unusual for the lower end of the tubing string to be anchored downhole and thereby straightens the tubing string into a sinusoidal wave pattern having less amplitude than an untensioned tubing string. This improved distribution of wear is helpful, but usually inadequate, and therefore it is desirable to further reduce the wear so that it is more evenly distributed between the sucker rod string and the tubing string.

Applicant has discovered that rotating the production tubing string respective to the sucker rod and casing string while concurrently placing the production tubing string in tension reduces the severity of wear of the curved tubing string by reducing the contact area between the tubing string and rod string and concurrently distributing the wear between the sucker rod string and the tubing string. This system of operation additionally reduces the cyclic working of the production string and thereby overcomes many of the above drawbacks while taking advantage of the recited benefits. Moreover, the unexpected benefit of enhancing the protection of the sucker rod and production tubing afforded by corrosion inhibitors is realized by continually moving the rod and tubing surface away from the contact area therebetween, thereby treating the surface of the rod and tubing string each rotation of the tubing string.

This novel and unobvious solution to the recited prior art problems, however, calls for a means by which the opposed ends of the tubing string can be rotatably anchored to thereby place the tubing string in tension while at the same time conveying production fluid into and up the production string and then away therefrom. Therefore, in order to achieve all of the above desired goals simultaneously, it is necessary to provide an upper fluid conveying sealed swivel for the upper end of the tubing string and to support and rotate the upper end of the tubing string respective to the wellhead, rod string, and casing string; and, for the rotatable tubing string to be connected to a downhole fluid conveying swivel and anchoring device so that the tension force in the lower end of the production tubing is transmitted into the lower borehole; all of which is further complicated by the necessity of being able to remove the lower swivel and anchoring device in order to service other subsurface equipment. Therefore, a method and apparatus must be provided by which the anchor device can selectively be released from the surface of the ground.

In the past this was achieved by rotating the tubing string counterclockwise to set the anchor device, and rotating the tubing string clockwise to release the anchor device. In the above example, however, the downhole swivel adjacent the anchor precludes the tubing string transmitting a torque to release the anchor device.

This invention provides an unobvious solution to the above problems by the provision of a unique combination by which a fluid conveying swivel, locking mechanism, and anchor device is actuated to set and release the anchor device in response to manipulation of the tubing string from the surface of the ground.

It is invention to rotatably suspend a tubing string from a wellhead and to place the tubing string in tension by releasably anchoring the lower marginal end of the tubing string to the interior of a well casing, and providing a downhole swivel at a location uphole of and near the anchor device; and, providing a rotating apparatus at the surface of the ground and means by which the lower swivel can be locked and unlocked by manipulating the tubing string from the surface of the ground.

The instant solutions to the old problem of crooked production wells is the subject of the present invention.

SUMMARY OF THE INVENTION

The present invention provides method and apparatus by which a tubing string located in a wellbore is placed under tension and rotated.

More specifically, a cased wellbore extends downhole from a wellhead to a pay zone which is produced by a rod actuated downhole pump that lifts fluid from the bottom of the wellbore up through a tubing string to the wellhead. A tubing rotator is attached adjacent the upper end of the production tubing string and rotatably supports the tubing string from the wellhead. A fluid conveying swivel means is attached above the rotator and conducts produced fluid from the upper terminal end of the tubing string.

A combination tubing anchor, fluid conveying swivel means, and locking device are attached adjacent the lower end of the tubing string by which the lower end of the tubing string is rotatably and releasably affixed to the casing in proximity to the lower end of the wellbore.

In one embodiment of the invention, the lower swivel means includes a sealed journal assembly and is located adjacent a tubing anchor that provides the means by which the tensioned tubing string can rotate respective to the tubing anchor and casing string while conveying fluid through the rotating tensioned production tubing string.

The lower sealed swivel means has a locking device comprising an upper cylinder that is attached to the tubing string; a J-pin retainer, a mandrel having a J-slot and groove formed therein, with the journal means and seal means being positioned between the upper cylinder and the J-pin retainer. The J-pin is moved from the J-slot into a wide groove to move the locking device from the locked into the unlocked configuration.

More specifically, in the preferred form of the invention, the locking device has a J-slot and a wide groove associated therewith that selectively allows locking and unlocking the swivel so that retraction and extension of the tubing anchor slips is achieved upon rotation of the tubing string clockwise and counter-clockwise whereby the tubing anchor slips are seated and unseated by rotation of the upper end of the tubing string. The tubing anchor, locking device and the swivel includes an axial passageway through which the sucker rod string passes when the pump is located therebelow. The tubing string can be placed in tension between the rotator and the anchor means and the tubing string rotated respective to the rod string and casing.

A primary object of the present invention is the provision of a combination tubing anchor and fluid conveying swivel means that can be attached adjacent the lower end of a tubing string and by which the lower end of the tubing string is rotatably and releasably affixed to the casing in proximity to the lower end of a wellbore.

Another object of the invention is to provide and disclose a lower swivel means that includes a sealed journal assembly located adjacent an anchor to provide means by which a tubing string can rotate respective to the anchor and well casing while conveying fluid through a rotating tensioned production tubing string.

A still further object of this invention is to provide a lower sealed swivel means that is attached to a production tubing string of a wellbore, and an anchor device located below the swivel means that is actuated by rotation of the tubing string when a J-pin and J-slot arrangement is moved between alternate positions of operation to lock and unlock the swivel means.

Another and still further object of this invention is the provision of method and apparatus for rotating the tubing string of a crooked wellbore respective to the sucker rod and casing string thereof while concurrently placing the string in tension and thereby reducing the severity of wear of the curved string by reducing the contact area between the tubing and rod string and concurrently distributing the wear between the sucker rod string and the tubing string.

An additional object of the present invention is the provision of a unique combination of a sealed swivel and fluid conveying releasing mechanism by which an anchor device is actuated between the set and released positions in response to movement of the tubing string that enables these manipulations to be achieved from the surface of the ground.

An additional object of the present invention is the provision of a rotatable production tubing string suspended from a wellhead and placed in tension by releasably anchoring the lower marginal end of the production tubing string to the interior of a well casing, and additionally providing a downhole swivel device uphole of the anchor device and at the same time provide a tubing rotator apparatus at the surface of the ground; and the further provision of means by which the downhole swivel can be locked and unlocked by manipulating the upper end of the tubing string from the surface of the ground so that the tubing string and other production equipment can be removed from the wellbore.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein for use with the disclosed method.

DETAILED DESCRIPTION OF THE PREFERRED EMBODIMENT

Figure 1:
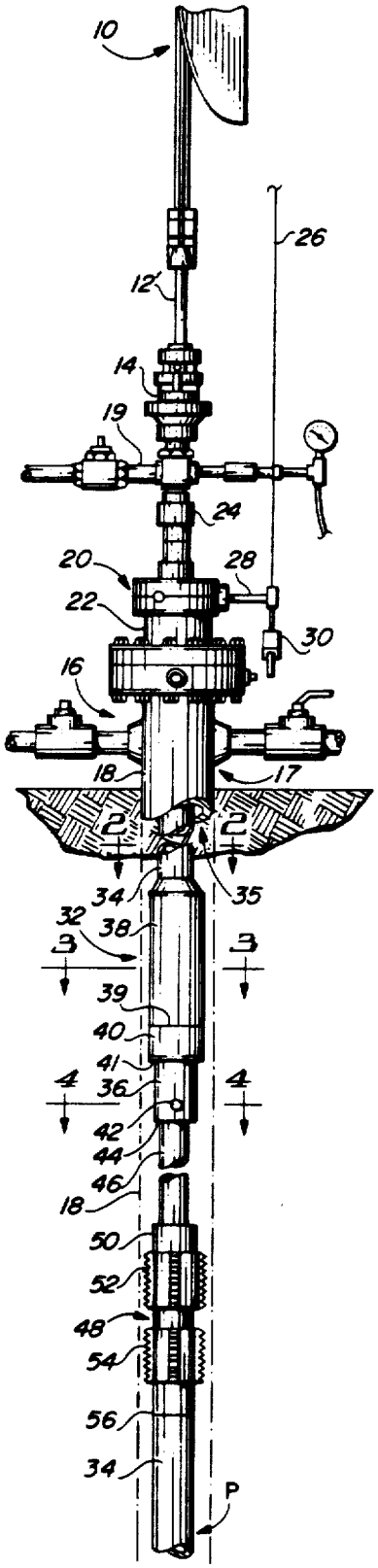
FIG. 1 is a broken, side elevational, part cross-sectional view of apparatus made in accordance with the present invention.

FIG. 1 of the drawings discloses a pumpjack unit 10 for reciprocating a polish rod 12' that sealingly extends through a stuffing box 14 and into a wellbore having a wellhead 16 at the upper end thereof. Numeral 17 indicates the usual surface casing while numeral 18 indicates the well casing string that is located therewithin. Produced fluid flows through pipe 19.

A tubing rotator 20, the details of which are more fully disclosed later on herein, is fastened to the wellhead by means of an adaptor 22. An upper fluid conveying swivel means 24 is interposed between stuffing box 14 and tubing rotator 20 so that the tubing string can convey fluid and rotate respective to the well-head, casing, and stuffing box. Actuator line 26 is attached to the free end of the ratchet arm 30 and is successively pulled by each oscillation of the rocking beam and thereby successively rotates or ratchets a shaft 28 by oscillating the ratchet arm 30 in response to each oscillation of the horsehead walking beam (not shown).

A downhole fluid conveying tubing swivel assembly 32, made in accordance with the present invention, has an upper end thereof connected to production tubing string 34. The tubing string 34 forms casing annulus 35 respective to the casing 18. The invention includes a novel J-pin retainer 36 that underlies a top sub 38. The top sub 38 is affixed to a journal or bearing retainer 40 along interface 39. Top sub 38 terminates at lower end 41. A J-pin 42 is affixed to J-pin retainer 36. A mandrel 46 has an upper end thereof affixed to the lower end 44 of J-pin retainer 36. A lower end of the mandrel 46 is affixed to upper end 50 of a downhole tubing catcher or anchor device 48. Slips 52 and 54 form part of and radially extend from anchor device 48 for engagement with the interior wall surface of casing 18. The lower end 56 of the anchor device 48 is attached to another length of production tubing string 34 within which a downhole pump P resides. It is customary for other downhole tools, such as gas anchors, seating nipples, and the like, to be included below the anchor device 48, all of which is well known to those skilled in the art.

Figure 2:
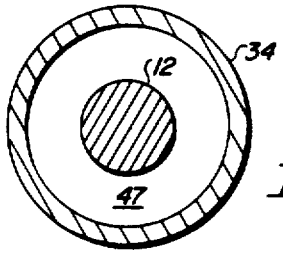
FIGS. 2, 3 and 4, respectively, are cross-sectional views taken along lines 2—2, 3—3 and 4—4 of FIG. 1, respectively.
Figure 3:
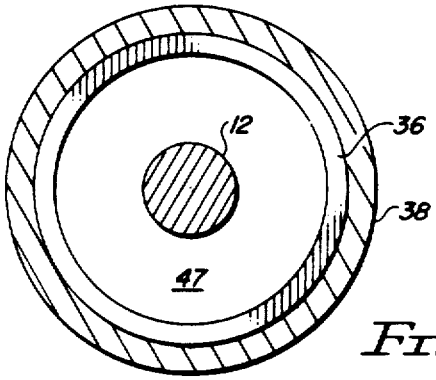

FIGS. 2 and 3 illustrate the rod string 12 extending through the production tubing and forming an annulus 47 within the swivel assembly 32. The apparatus 32, 36, 48 has an interior diameter that is at least equal to the inside diameter of the tubing string so that anything that can be lowered down through the production tubing string can also be extended through the apparatus of the present invention.

Figure 4:
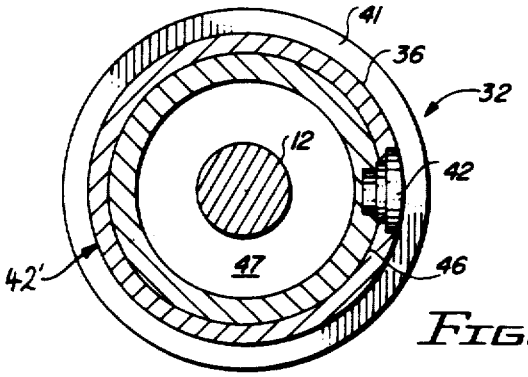

FIG. 4, together with FIGS. 1 and 3, illustrates the relationship between the various parts of lower swivel assembly 32 and particularly discloses a locking device having a J-pin 42 captured within a J-slot, the details of which will be more fully discussed later on in this disclosure.

Figure 5:
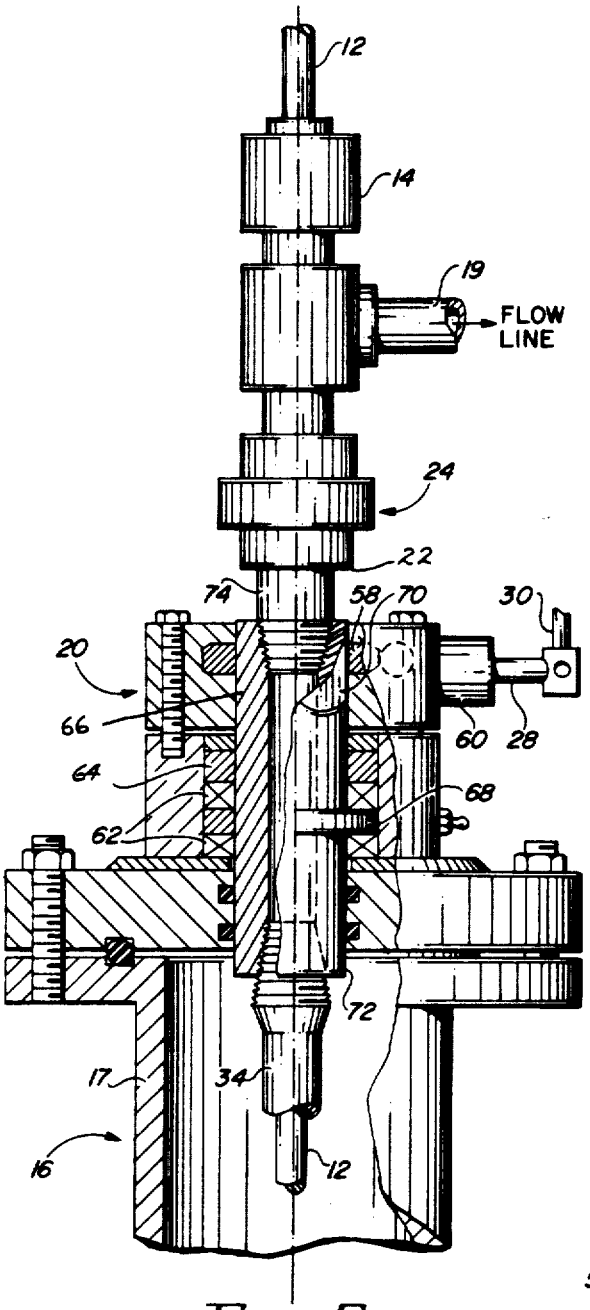
FIG. 5 is an enlarged, broken, part cross-sectional detail of part of the apparatus disclosed in FIG. 1.

Looking now to the details of FIG. 5, together with FIG. 1, a gear 58 is meshed with a worm 60 and arranged to be rotated by the rotatable shaft 28. The gear and worm can take on a number of different forms so long as rotation of shaft 28 imparts rotation into gear 58. The ratio between the gear 58 and worm 60 preferably is about 100 to 1. This will rotate the tubing string 34 about one revolution each day.

Bearings 62 confront one another while a seal assembly 64 is arranged to prevent loss of grease from the apparatus. A hanger mandrel 66 is provided with an enlargement 68 at a medial portion thereof that radiates from and circumferentially extends about the mandrel to provide opposed circumferentially extending shoulders that engage and rotatably ride against the spaced bearings 62. The bearings 62 therefore rotatably capture the hanger mandrel 66 therebetween. The hanger mandrel 66 is hollow for passage of sucker rod 12 and produced fluid therethrough. The lower interior end 72 of the mandrel threadedly receives the upper threaded terminal end of the production tubing string 34 therein, while a marginal outer surface of the upper end 70 thereof is splined and mates with the complementary configured gear 58 of the gear and worm drive. Numeral 74 is a connector by which upper swivel means 24 is connected to hanger mandrel 66.

Figure 7:
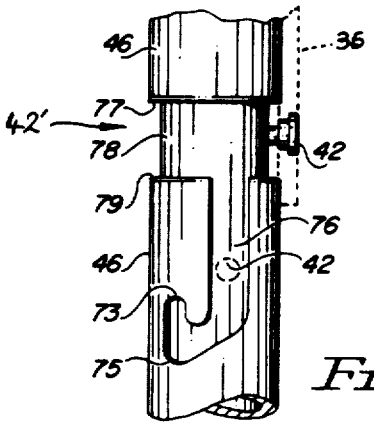
Figure 6:
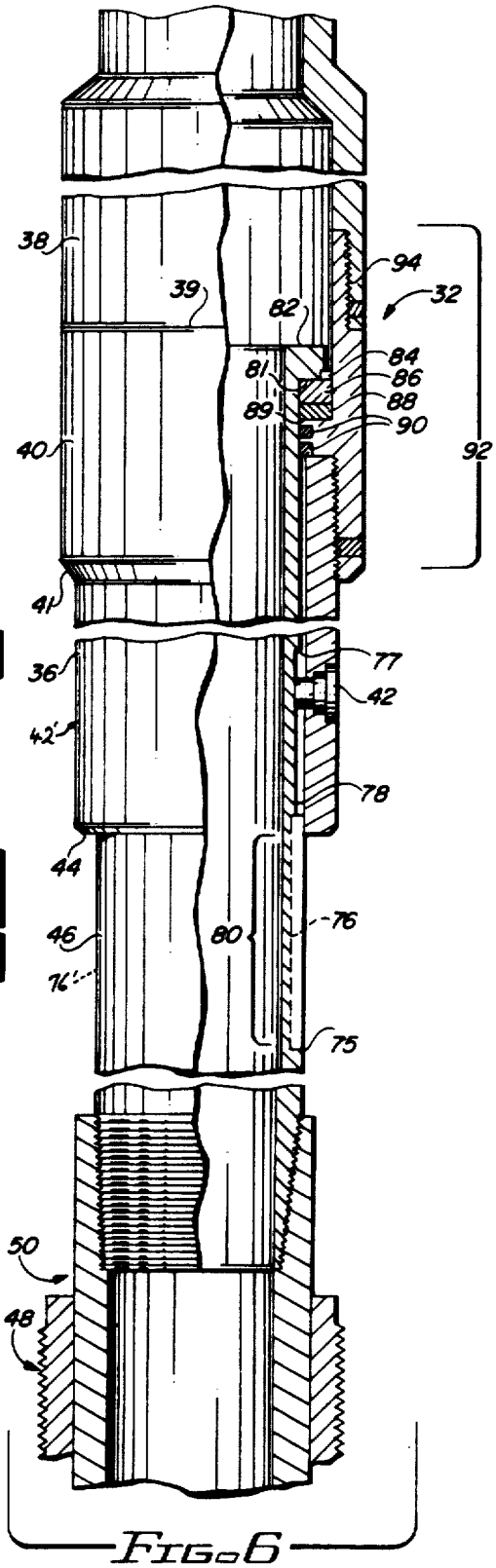
FIG. 6 is an enlarged, fragmentary, part cross-sectional view of part of the apparatus disclosed in FIG. 1; and, FIG. 7 is an enlarged, fragmentary, part cross-sectional detail of part of the apparatus disclosed in FIGS. 1 and 6.

FIG. 6, together with FIGS. 1, 4 and 7, shows further details of the invention, and particularly illustrates the locking device by which the downhole swivel is selectively made free wheeling or locked. The J-pin 42 is affixed to J-pin retainer 36. The inwardly directed part of the pin is captured for movement within and along the J-slot 76 which extends downwardly from a circumferentially extending wide groove 78 located at the upper terminal end of the J-slot. The wide groove 78 communicates with the J-slot 76 to enable the J-pin 42 to travel anywhere along the length of the slot. The J-pin retainer 36 can be rotated respective to the mandrel 46 when the J-pin 42 is aligned with the circumferentially extending wide groove 78.

As particularly seen in FIGS. 6 and 7, J-slot 76 has a lower curved portion 75 that terminates at 73. Those skilled in the art can now readily see that mandrel 46, when the J-pin is in the wide groove 78, can be rotated to align the J-pin 42 with J-slot 76, whereupon the J-pin 42 can move and be guided downward along the slot to the dot-dash illustrated position, and thereafter continue to travel until the pin bottoms out at curve 75, whereupon picking up the mandrel results in the J-pin being seated at the blind terminal end 73 of J-slot 76. In this position, the locking device has rendered the swivel non-rotatable, and the mandrel can be used to rotate the anchor device in either direction by rotating the upper end of the tubing string at the surface of the ground.

Numeral 80 of FIG. 6 indicates the range of travel of the pin 42 below the wide groove 78. Enlarged shoulder 82 of the mandrel 46 outwardly extends into close proximity of the interior wall of the top sub 38; and, provides a lower shoulder 81 that abuts a ring bearing 84 that is seated within the illustrated groove.

Bearing ring 86 and bearing 88 are captured between the confronting shoulders 81 and 89. Seal rings 90 seal the annular passageway formed between the J-pin retainer 36 and the top sub 38. Bearing retainer 92 forms the lower marginal end of the top sub 38 and enables the apparatus to be disassembled. Numeral 94 indicates a threaded area between the two members.

In operation, the tubing anchor device 48 is interposed within the tubing string immediately above pump P, the downhole tubing swivel assembly 32 is interposed in the tubing string immediately above the tubing anchor device 48, the locking device is in the locked position, and the apparatus is run downhole into the borehole on the tubing string to a predetermined depth. At this time, the J-pin 42 is in the blind end 73 of the J-slot 76 so that the upper end of the tubing string can subsequently be rotated, preferably to the left, to extend and set slips 52, 54 of anchor device 48.

Then the wellhead 16, along with the tubing rotator 20 and other illustrated members, are all assembled in the manner of FIG. 1. Next, the tubing string is set down, causing mandrel 46 to urge the J-pin into curve 75 of the J-slot; whereupon the tubing is then picked up, using a weight indicator, to assure that J-pin 42 travels further up into the circumferentially extending wide groove 78. The groove 78 will at first appear to be excessively wide until it is realized that there must be ample lost motion between the coacting parts to assure that the confronting shoulders 81 and 89 of the bearing assembly 84, 86, and 88 carries the tension load of the tubing string rather than the J-pin 42 abutting the upper circumferential edge 77 of the groove 78. Hence, it is desirable that J-pin 42 comes to rest more or less equally spaced between the shoulders 77 and 79 of the groove 78 in the illustrated manner of FIGS. 6 and 7 whereby J-pin 42 is free to rotate within groove 78 under normal production conditions during rotation of the tubing string.

At this time, rotator 20 is connected in the manner of FIG. 1 so that oscillation of the rocking beam of a pumpjack unit moves the actuator line 26 each upstroke of the polish rod and thereby oscillates ratchet arm 30 which in turn successively rotates shaft 28 to thereby rotate worm 60 to drive gear 58 and thereby rotate the hanger mandrel 66 which in turn rotates tubing string 34 all the way from upper swivel means 24 down to the lower end 44 of the J-pin retainer 36.

In FIG. 5, slips can be used to releasably secure the tubing string to the hanger mandrel 66 in lieu of the illustrated internal threads. In this instance, the tubing string 34 extends into threaded engagement with the swivel means 24 while an upper marginal end portion of the tubing string 34 is releasably held within the hanger mandrel by the slips. This enables the tension in the tubing string to be easily adjusted and simplifies the job of spacing out all of the upper and lower swivels, anchors, hangers, and other equipment.

In FIGS. 4, 6 and 7, a plurality of J-pins 42 and J-slots 76 can be incorporated into the tool as noted at 42' and 76'. Preferably, the J-pins and J-slots are spaced 180 degrees apart, but could be placed 120 degrees apart if desired.

I claim:

1. In a production unit for a cased wellbore having a wellhead and a rod actuated downhole pump for producing fluid up a tubing string to the surface of the ground, the combination with said production unit of apparatus for rotating the tubing string while holding the tubing string in tension;

said apparatus includes a tubing rotator by which the upper end of the tubing string is rotatably supported from the wellhead; a downhole tubing swivel connected at the lower end of the tubing string; an anchor device by which a lower end of the tubing swivel is anchored to the casing string;

said downhole tubing swivel has a mandrel connected to said anchor device, a rotatable top sub that is connected to a J-pin retainer sub and rotates respective to the mandrel;

journal means by which said rotatable top sub and tubing string rotates respective to said mandrel and anchor device;

a J-pin in said J-pin retainer sub, a J-slot and a circumferentially extending groove in said mandrel engaged by said J-pin such that when the tubing string is set down the J-pin travels into the J-slot and locks the mandrel to the J-pin retainer sub which imparts rotation into the mandrel when the upper end of the tubing is rotated, and when the J-pin is lifted from the J-slot into the circumferentially extending groove, the J-pin travels in the circumferentially extending groove as the tubing string is rotated, whereby: the tubing string, top sub, and J-pin retainer rotate respective to said mandrel and anchor device.

2. The combination of claim 1 wherein the anchor device has slips thereon that are moved radially outwardly into engagement with the interior surface of the casing when the mandrel is rotated in one direction by the J-pin retainer sub, and which are retracted away from the casing when the mandrel is rotated in the other direction;

and wherein said J-slot has a vertical length extending from the groove that receives the J-pin therein when the downhole swivel is locked.

3. The combination of claim 1 wherein said tubing rotator is affixed to the wellhead and includes a gear and worm therein, wherein the gear engages a hanger mandrel and rotates the hanger mandrel while the gear is rotated by the worm, which in turn is rotated by reciprocation of the production unit; and means by which the tubing is removably attached to the hanger mandrel.

4. The combination of claim 3 wherein the hanger mandrel has a spline at one end and a box at the lower end to which the upper end of the tubing string is attached, and further including an enlargement forming opposed shoulders, and bearing means at said opposing shoulders for supporting said hanger mandrel.

5. The combination of claim 1 wherein a swivel is provided above the tubing rotator, and said tubing rotator includes a hanger mandrel journaled within a housing and having a medial circumferentially extending enlargement forming opposed faces thereon for engaging a bearing means;

and means on said hanger mandrel for releasably engaging an upper end of the tubing string, spline means for engaging a gear and worm that rotates the hanger mandrel;

whereby the hanger mandrel pulls the upper end of the tubing string uphole while the anchor device pulls the lower end of the tubing string downhole and thereby places the tubing string in tension.

6. In a cased wellbore having a rod actuated downhole pump for producing fluid up a tubing string to the surface of the ground, a wellhead at the top of the casing, an anchor device by which the lower end of the tubing string is anchored to the casing to place the tubing string in tension; the improvement comprising;

a tubing rotator means for rotatably suspending the upper end of the tubing string from the wellhead; an upper swivel means connected to the tubing string at a location above the wellhead through which produced fluid can flow; a lower swivel means interconnecting the lower end of the tubing string to said anchor device and placing the tubing string in tension, said lower swivel means being located below the wellhead and in close proximity to the anchor device through which produced fluid can flow; said anchor device is in close proximity to the downhole pump;

locking means connected to selectively lock and unlock said lower swivel means in response to manipulation of the tubing string; means by which said tubing string, when the lower swivel means is locked, can be manipulated by rotation thereof in one direction to set and by rotation thereof in the other direction to release the anchor device from engagement with the borehole, whereby; said tubing string is placed in tension between said tubing rotator means and said anchor device and the tensioned tubing string is rotated by said tubing rotator means when the lower swivel means is unlocked.

7. The improvement of claim 6 wherein said locking means of said lower swivel means includes a mandrel affixed to said anchor device;

a J-pin retainer, a J-pin affixed to said J-pin retainer, a J-slot in said mandrel, a circumferentially extending groove in communication with the J-slot; said J-pin enters the J-slot to lock the lower swivel means, said J-pin enters the groove to unlock the lower swivel means; said anchor device is extended into attached relationship respective to the casing and is retracted in response to said mandrel being rotated by the tubing string.

8. The improvement of claim 6 wherein a tubing rotator is affixed to the wellhead and includes a gear and worm therein, wherein the gear engages a hanger mandrel and rotates the mandrel while the gear is rotated by a worm which in turn is rotated by reciprocation of a pumpjack unit.

9. The improvement of claim 8 wherein the hanger mandrel has a spline at one end and a box at the lower end to which the upper end of the tubing string is attached, and further including an enlargement forming opposed shoulders, and bearing means on said opposed shoulders for supporting said hanger mandrel.

10. The improvement of claim 6 wherein said upper swivel means is provided above the tubing rotator means and below a stuffing box, and said tubing rotator means includes a hanger mandrel journaled within a housing and having a medial circumferentially extending enlargement forming opposed faces thereon for engaging bearing means;

and a spline at the upper end of said hanger mandrel and a box at the lower end thereof, said box engages the upper end of the tubing string while said spline engages a gear and worm that rotates the hanger mandrel;

whereby the hanger mandrel places the upper end of the tubing string in tension while the anchor device places the lower end of the tubing string in tension with there being a passageway that extends through said upper swivel means, hanger mandrel, tubing string, lower swivel means and through the anchor device through which the rod reciprocatingly extends.

11. In a wellbore having a rod actuated downhole pump for producing fluid up a tubing string to the surface of the ground, a wellhead at the top of the wellbore, an anchor device by which a lower end of the tubing string is anchored to a lower end of the wellbore to place the tubing string in tension; a method of reducing wear between a sucker rod string and the interior wall of the tubing string through which the rod string extends, comprising the steps of:

rotatably connecting the lower end of the tubing string to said anchor device by interposing a tubing swivel between said tubing string and said anchor device, connecting the upper end of the tubing string to a tubing rotating means and supporting the tubing rotating means from the wellhead;

locking the tubing swivel that is located at the lower end of the tubing string and extending said anchor device into attached relationship respective to the wellbore wall by rotating the tubing string in one direction;

unlocking the last said swivel and placing the tubing string in tension by using the tubing rotating means to pull the upper end of the tubing string uphole and using the last said tubing swivel to pull the lower end of the tubing string downhole;

rotating the tubing string from the surface while conveying fluid through the tensioned rotating tubing string;

releasing the anchor device by locking the tubing swivel and rotating the tubing in the other direction.

12. The method of claim 11 and further including the steps of including a hanger mandrel as part of said tubing rotating means and rotating said hanger mandrel in response to reciprocation of the rod, and suspending the tubing string from said hanger mandrel.

13. The method of claim 11 and further including the steps of supporting a hanger mandrel within said tubing rotating means, rotating said hanger mandrel to which the upper end of the tubing string is attached, and further including the step of forming an enlargement having opposed shoulders on said hanger mandrel, and supporting said hanger mandrel on bearing means at said opposed shoulders.

14. The method of claim 11 and further including the steps of providing a swivel joint above the tubing rotating means and below a stuffing box;

using the tubing rotating means to place the upper end of the tubing string in tension while the anchor places the lower end of the tubing string in tension; forming a passageway that extends through said swivel joint, tubing rotating means, tubing string, lower swivel and through the anchor device through which the rod reciprocatingly extends.

15. In a cased wellbore that is produced by a rod actuated downhole pump to lift fluid up through a tubing string to a wellhead at the surface of the ground, the improvement comprising:

a tubing rotator by which the upper end of the tubing string is rotated; a swivel means near the upper end of the tubing string through which produced fluid can flow;

a tubing anchor near the lower end of the tubing string;

a lower swivel means adjacent said anchor by which the tubing string can rotate respective to said anchor through which produced fluid can flow;

said lower swivel means has an upper cylinder attached to the tubing string; a J-pin retainer affixed to said upper cylinder; a J-pin mounted to said J-pin retainer; a mandrel having a J-slot and a groove formed therein; said mandrel is affixed to said anchor; journal means between said upper cylinder and said mandrel by which said lower swivel can rotate respective to the anchor;

whereby, the tubing string can be placed in tension between the rotator and the anchor and the tubing string rotated respective to the mandrel when the J-pin rides in the groove, and the J-pin enters the J-slot to allow the tubing anchor to be set and unset by movement of the tubing string.

* * * * *